US008205867B2

(12) United States Patent
Kamiya

(10) Patent No.: US 8,205,867 B2
(45) Date of Patent: Jun. 26, 2012

(54) SHEET PROCESSING APPARATUS AND IMAGE FORMING APPARATUS

(75) Inventor: Daisaku Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/961,656

(22) Filed: Dec. 7, 2010

(65) Prior Publication Data

US 2011/0074103 A1 Mar. 31, 2011

Related U.S. Application Data

(63) Continuation of application No. 12/470,668, filed on May 22, 2009, now Pat. No. 7,866,651, which is a continuation of application No. 11/470,787, filed on Sep. 7, 2006, now Pat. No. 7,556,251.

(30) Foreign Application Priority Data

Sep. 13, 2005 (JP) ..... 2005-264780

(51) Int. Cl.
*B65H 37/04* (2006.01)

(52) U.S. Cl. ..... 270/58.12; 270/58.07; 270/58.08; 270/58.17

(58) Field of Classification Search ..... 270/58.08, 270/58.09, 58.12, 58.17
See application file for complete search history.

(56) References Cited

U.S. PATENT DOCUMENTS

| | | | |
|---|---|---|---|
| 6,145,825 | A | 11/2000 | Kunihiro et al. |
| 6,290,220 | B1 | 9/2001 | Takehara et al. |
| 6,529,693 | B2 | 3/2003 | Tomizawa et al. |
| 6,834,167 | B2 | 12/2004 | Tomizawa et al. |
| 6,845,228 | B2 | 1/2005 | Suzuki et al. |
| 6,889,971 | B2 | 5/2005 | Tamura et al. |
| 7,152,856 | B2 | 12/2006 | Kamiya et al. |
| 7,419,150 | B2 | 9/2008 | Kushida et al. |
| 7,431,273 | B2 | 10/2008 | Kamiya et al. |
| 7,475,876 | B2 | 1/2009 | Kamiya et al. |
| 2002/0018659 | A1 | 2/2002 | Tomizawa et al. |
| 2003/0086716 | A1 | 5/2003 | Tomizawa et al. |

FOREIGN PATENT DOCUMENTS

| | | |
|---|---|---|
| JP | 11-334975 | 12/1999 |
| JP | 2000-075573 | 3/2000 |

*Primary Examiner* — Leslie A Nicholson, III
(74) *Attorney, Agent, or Firm* — Fitzpatrick, Cella, Harper & Scinto

(57) ABSTRACT

Provided is a sheet processing apparatus for processing sheets, including: a sheet process tray on which sheets to be processed are stacked; a sheet transport means for transporting processed sheets on the sheet process tray; a pressure member which is provided on an upstream side of the sheet transport means with respect to a sheet transport direction and which moves in the sheet transport direction while pressing the processed sheets, for transporting the processed sheets in cooperation with the sheet transport unit; and a controller for selectively operating the pressure member.

6 Claims, 14 Drawing Sheets

SHEET PROCESSING APPARATUS AND IMAGE FORMING APPARATUS

This is a continuation of U.S. patent application Ser. No. 12/470,668, filed May 22, 2009, allowed Sep. 7, 2010, which is a continuation of U.S. patent application Ser. No. 11/470,787, filed Sep. 7, 2006, now U.S. Pat. No. 7,556,251, issued Jul. 7, 2009.

BACKGROUND OF THE INVENTION

1. Field of the Invention

The present invention relates to a sheet processing apparatus and an image forming apparatus.

2. Description of the Related Art

Conventionally, in some image forming apparatuses, such as copying machines, printers, facsimile apparatuses, and multi-function apparatuses composed of combinations of these, an image forming apparatus main body is provided with a sheet processing apparatus for performing a processing, such as alignment or binding, on sheets delivered from the image forming apparatus main body. In an example of such the sheet processing apparatus, the delivered sheets are stacked and aligned on a process tray, and then a processing, such as binding, is performed on the sheets (i.e., sheet bundle).

FIG. 12 is a diagram showing an example of such the conventional sheet processing apparatus. In a sheet processing apparatus 100A, sheets that have undergone image formation in the image forming apparatus main body are temporarily stacked on a process tray 138, on which a processing, such as alignment or binding, is performed on the sheet bundle. When the processing is completed, the sheet bundle is delivered onto a stack tray 137 with an inclined sheet bundle surface by sheet bundle delivery rollers 130.

In the sheet processing apparatus 100A, a length in the sheet transport direction (hereinafter, simply referred to as "length") of the process tray 138, that is, a distance from a trailing end regulating member 3 for regulating trailing ends of the sheets to the sheet-bundle discharge rollers 130, is 180 mm or less. Thus, when sheets of a large size, such as A3 or LDR, are to be processed, while the sheet trailing ends are stacked on the process tray 138, leading ends of these are stacked on the stack tray (or on the already stacked sheets) for alignment (see Japanese Patent Application Laid-open No. H11-334975).

This construction is effective in achieving space saving for the apparatus as a whole. Further, it is possible to transport sheet bundles of half sizes, such as A4 and B5, by the sheet-bundle discharge rollers 130 alone.

FIG. 13 is a diagram showing a conventional sheet processing apparatus of another construction. In this sheet processing apparatus, a length of a process tray 209, that is, a distance from a trailing end regulating member 210 to a sheet-bundle discharge roller 208, is larger as compared with that of the process tray 138 of the sheet processing apparatus 100 shown in FIG. 12. Thus, even sheets of large sizes, such as A3 and LDR, can be aligned, with their entire surfaces placed on the process tray.

With this construction, even in a case in which large size sheets are aligned, the sheets are not exposed to the exterior of a sheet processing apparatus main body F, so there is no fear of a user erroneously extracting the sheets before the processing is over.

However, in the sheet processing apparatus F, the distance from the trailing end regulating member 210 to the sheet bundle discharge roller 208 is large, so it is impossible to transport the sheet bundles of half sizes, such as A4 and B5, by the sheet bundle discharge rollers 130 alone. Thus, a sheet bundle thrust member 219 is separately provided. When transporting the half-size sheet bundle, the sheet bundle is delivered by transporting it to the sheet bundle discharge roller 208 by the sheet bundle thrust member 219 (see Japanese Patent Application Laid-open No. 2000-075573).

In conventional sheet processing apparatuses, there are cases in which, for example, sheets with surfaces of a small coefficient of friction with color images transferred thereto are to be aligned. In this case, when the sheet bundle is delivered by the sheet bundle discharge rollers 130 alone as in the case of FIG. 12, upper sheets Pa and lower sheets Pb of a sheet bundle PA can be transported by the sheet bundle discharge rollers 130 as shown in FIG. 14. However, sheets Pc in a central portion of the sheet bundle PA slip, so sheet bundle transport cannot be effected properly.

In a case in which, as shown in FIG. 13, the sheet bundle thrust member 219 is arranged, the sheet bundle can be delivered reliably. However, even when the sheet bundle can be transported by the sheet bundle discharge roller 208 alone, it is necessary to operate the trailing end thrust member 219.

Further, even in, for example, a double binding mode, in which a sheet bundle is bound by stapling at two positions and in which the sheets Pc in the central portion of the sheet bundle PA do not slip, so the trailing end thrust member 219 is not necessary, the trailing end thrust member 219 is operated. Thus, there are involved problems, such as large power consumption, generation of noise, and impairing of durability of the trailing end thrust member.

Further, in order that the sheet bundle may be transported by the trailing end thrust member 219 even when the sheet bundle contains a large number of sheets (e.g., 100 sheets), a large motor is employed. Here, when a large motor is thus employed, an impact when the trailing end thrust member 219 abuts the sheet bundle is large if, in particular, the number of sheets in the sheet bundle is small, so, to mitigate the impact, the trailing end thrust member 219 is moved at low acceleration (i.e., at low speed).

However, when the trailing end thrust member 219 is thus moved at low acceleration (i.e., at low speed), a requisite processing time is rather long. That is, when a large motor is employed, not only is the size of the apparatus increased but also the requisite processing time increases when the trailing end thrust member 219 is moved at low acceleration (i.e., at low speed) in order to mitigate the impact when the trailing end thrust member 219 abuts the sheet bundle, thereby resulting in a deterioration in productivity.

SUMMARY OF THE INVENTION

The present invention has been made in view of the above-mentioned problems in the prior art. It is therefore an object of the present invention to provide a sheet processing apparatus and an image forming apparatus capable of achieving a reduction in power consumption, prevention of noise generation, an improvement in durability, an improvement in productivity, and space saving.

According to the present invention, a sheet processing apparatus for processing sheets includes: a sheet process tray on which sheets to be processed are stacked; a sheet transport means for transporting processed sheets on the sheet process tray; a pressure member which is provided on an upstream side of the sheet transport means with respect to a sheet transport direction and which moves in the sheet transport direction while pressing the processed sheets, for transporting the processed sheets in cooperation with the sheet transport means; and a controller for selectively operating the pressure member.

According to the present invention, an apparatus comprising: a sheet tray on which sheets are stacked; a sheet transport rotary member which transports the sheets on the sheet tray by rotating, wherein a peripheral surface of said transporting rotary member contact with the sheets; a pressure member which transports the sheets on the sheet tray in cooperation with the sheet transport rotary member by moving in the sheet transport direction while contacting the edge of the sheets; and a controller for selectively operating the pressure member.

Further features of the present invention will become apparent from the following description of exemplary embodiments (with reference to the attached drawings).

DESCRIPTION OF THE PREFERRED EMBODIMENTS

In the following preferred embodiments of the present invention will be described with reference to the drawings.

Figure 1:
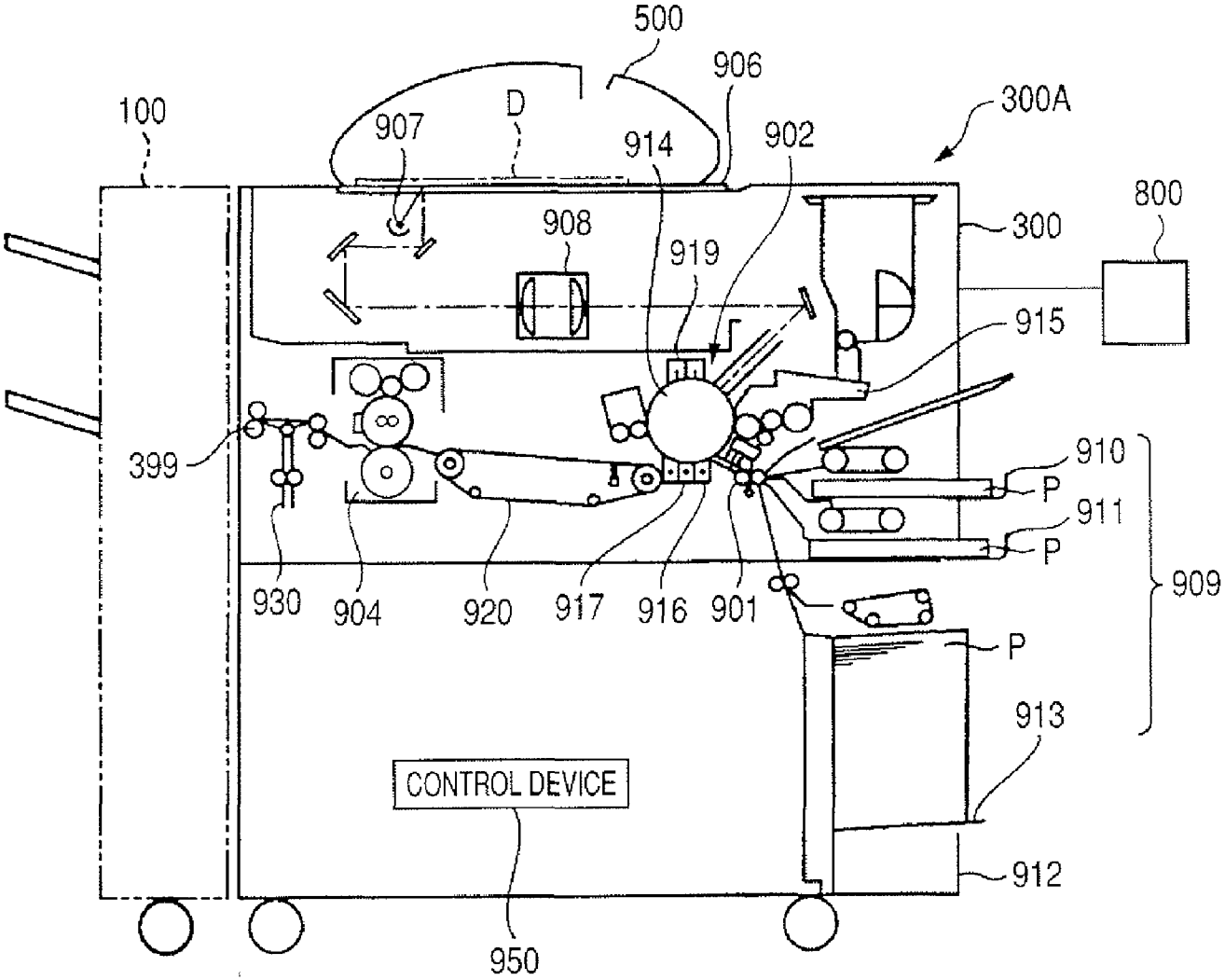
FIG. 1 is a diagram showing a construction of a copying machine constituting an example of an image forming apparatus equipped with a sheet processing apparatus according to a first embodiment of the present invention.

FIG. 1 is a diagram showing the construction of a copying machine constituting an example of an image forming apparatus equipped with a sheet processing apparatus according to the first embodiment of the present invention. In FIG. 1, numeral 300A indicates a copying machine, and numeral 300 indicates a copying machine main body (an image forming unit). The copying machine main body (hereinafter, referred to as apparatus main body) 300 is equipped with a platen glass 906 serving as the original table, a light source 907, and a lens system 908.

The apparatus main body 300 is equipped with a sheet feeding portion 909, an image forming portion 902, and an auto document feeder 500 for feeding an original D to the platen glass 906. Connected to the apparatus main body 300 are a sheet processing apparatus 100 for processing sheets having undergone image formation delivered from the apparatus main body 300, etc.

The sheet feeding portion 909 has cassettes 910 and 911 for accommodating recording sheets P, which are detachable with respect to the apparatus main body 300, and a deck 193 arranged on a pedestal 912. The image forming portion 902 is equipped with a cylindrical photosensitive drum 914, around which there are provided a developing device 915, a transfer charger 916, a detach charger 917, a cleaner 918, a primary charger 919, etc.

On the downstream side of the image forming portion 902, there are arranged a transport device 920, a fixing device 904, a discharge roller pair 399, etc. Numeral 950 indicates a control device for controlling the image forming operations in general of the apparatus main body 300.

Next, the operation of the copying machine 300A, constructed as described above, will be illustrated.

When a sheet feeding signal is output from a control device 950 provided in the apparatus main body 300, light is applied from the light source 907 to the original D placed on the original table 906, and the light reflected from the original D is applied to the photosensitive drum 914 through the lens system 908. Here, the photosensitive drum 914 is previously charged by the primary charger 919; through the application of light, an electrostatic latent image is formed on the photosensitive drum, and then the electrostatic latent image is developed by the developing device 915, whereby a toner image is formed on the photosensitive drum.

In the sheet feeding portion 909, a sheet P is fed from the cassette 910 or 911 or the deck 193; the sheet P undergoes skew feed registration at registration rollers 901, and is sent to the image forming portion 902 in synchronism therewith.

In the image forming portion 902, the toner image on the photosensitive drum 914 is transferred to the transported sheet P by the transfer charger 916. After that, the sheet P to which the toner image has been transferred is charged by the detach charger 917 to a polarity opposite to that of the transfer charger 916, and is separated from the photosensitive drum 914.

The separated sheet P is transported to the fixing device 904 by the transport device 920, and the transferred image is permanently fixed to the sheet P by the fixing device 904. Further, the sheet P to which the image has been fixed is delivered from the apparatus main body 300 by the discharge roller pair 399 in a straight discharge mode in which the image surface is on the upper side or in a reversal discharge mode in which the sheet is transported to a sheet surface reverse path 930 to be delivered with the image surface on the lower side. In this way, the sheet P fed from the sheet feeding portion 909 undergoes image formation, and delivered into the sheet processing apparatus 100.

Figure 2:
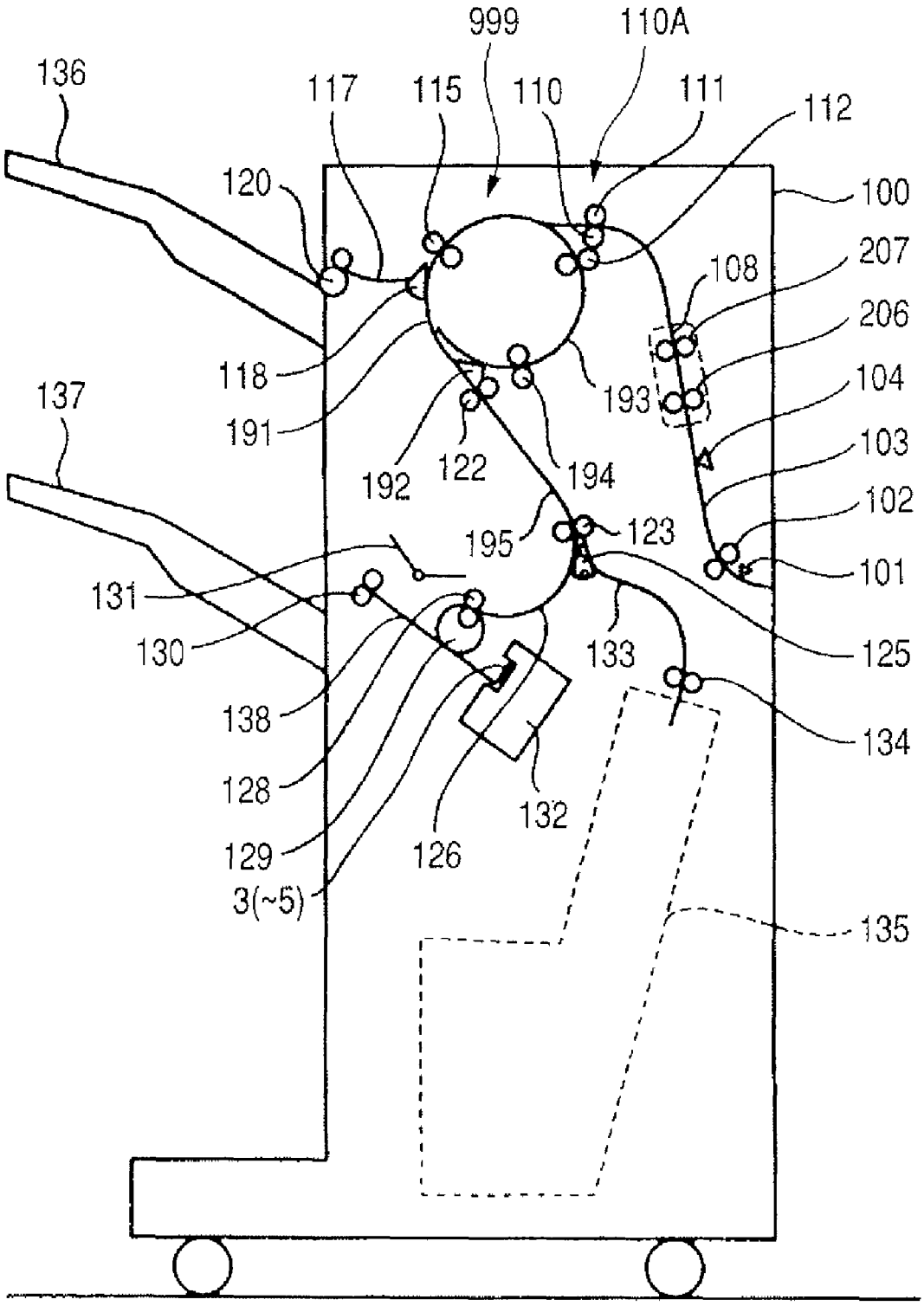
FIG. 2 is a diagram showing the construction of the sheet processing apparatus.

FIG. 2 is a diagram showing the construction of the sheet processing apparatus 100. As shown in FIG. 2, the sheet processing apparatus 100 is equipped with a lateral registration detecting sensor 104 for detecting the position of an end portion of a sheet, and a shift unit 108 which is provided with shift roller pairs 206 and 207 and which is movable in a width direction.

Further, the sheet processing apparatus 100 is equipped with a buffering portion 999 provided with a plurality of buffer roller pairs 115, 194, and 112 capable of retaining a plurality of sheets, and a buffer path 193, a saddle unit 135 for performing a saddle stitch process (saddle stitching), a stapler 132 for binding sheet bundles, etc. In FIG. 2, numeral 138 indicates a process tray serving as a sheet stacking portion on which sheets are temporarily stacked when performing a processing on sheets.

In the sheet processing apparatus 100, constructed as described above, when a sheet is delivered from the apparatus main body 300, the sheet is first delivered to an entry roller pair 102 shown in FIG. 2. At this time, the sheet discharge timing is simultaneously detected by an entry sensor 101.

Next, the sheet transported by the entry roller pair 102 passes through a transport path 103, and during this process, the position of an end portion thereof is detected by the lateral registration detecting sensor 104, and the degree of its deviation in the width direction from the central position (i.e., center) of the sheet processing apparatus 100 is detected.

Next, after a lateral registration error is thus detected, the sheet is nipped by the shift roller pairs 206 and 207 of the shift unit 108. After that, the shift roller pairs 206 and 207 are moved in the width direction, whereby the sheet is transported while undergoing lateral registration correction. After that, the sheet, which has thus undergone lateral registration correction, is transported to the first buffer roller pair 115.

Next, when it is to be delivered onto an upper tray 136, the sheet transported to the first buffer roller pair 115 is guided to an upper path transport path 117 through switching of an upper path switching flapper 118 by a driving means, such as a solenoid (not shown). After that, the sheet is delivered onto the upper tray 136 by an upper discharge roller 120.

When the sheet is not to be delivered onto the upper tray 136, for example, when a sheet bundle previously stacked on the process tray 138 is undergoing stapling, the sheet is subjected to buffering by the buffering portion 999.

That is, the sheet transported by the first buffer roller pair 115 guided to a path 191 through switching of the upper path switching flapper 118, and, thereafter, guided to the buffer path 193 by a buffering flapper 192. Further, the sheet guided to the buffer path 193 is transported by the second buffer roller pair 194 and the third buffer roller pair 112, which are provided in the buffer path 193.

Here, after that, the sheet transported by the second buffer roller pair 194 and the third buffer roller pair 112 is transported together with a subsequent sheet transported by a transport roller pair 110A; at this time, the transport is effected with the respective leading ends of the sheets being matched with each other, that is, with the two sheets being superimposed one upon the other.

The two sheets thus superimposed one upon the other are transported by the first buffer roller pair 115, and are again guided to the path 191 by the upper path switching flapper 118; thereafter, they are guided to the buffer path 193 by the buffering flapper 192. After that, they are transported by the second buffer roller pair 194 and the third buffer roller pair 112. Further, after that, these two sheets superimposed one upon the other are transported, with their leading ends being matched with the leading end of another, third sheet transported by the transport roller pair 110A.

Then, the three sheets, thus superimposed one upon the other, are transported by the first buffer roller pair 115, and guided to the path 191 by the upper path switching flapper 118. After that, the sheets are guided to a sheet bundle transport path 195 by the buffering flapper 192, which has been switched to the sheet bundle transport path side 195, and are successively passed through the sheet bundle transport path 195 by sheet bundle transport roller pairs 122 and 123.

Here, when saddle stitching is to be performed on the sheets, the three sheets are transported to a saddle path 133 by switching a saddle switching flapper 125 to the side of the saddle unit 135. After that, the sheets are guided by a saddle entry roller pair 134 to the saddle unit 135, where they undergo saddle stitching (saddle stitch process).

When the three sheets transported are to be delivered onto a lower tray 137, the sheets transported to the sheet bundle transport roller pair 123 are transported to a lower path 126 by the saddle switching flapper 125, which has been switched to the lower path 126 side.

Figure 3:
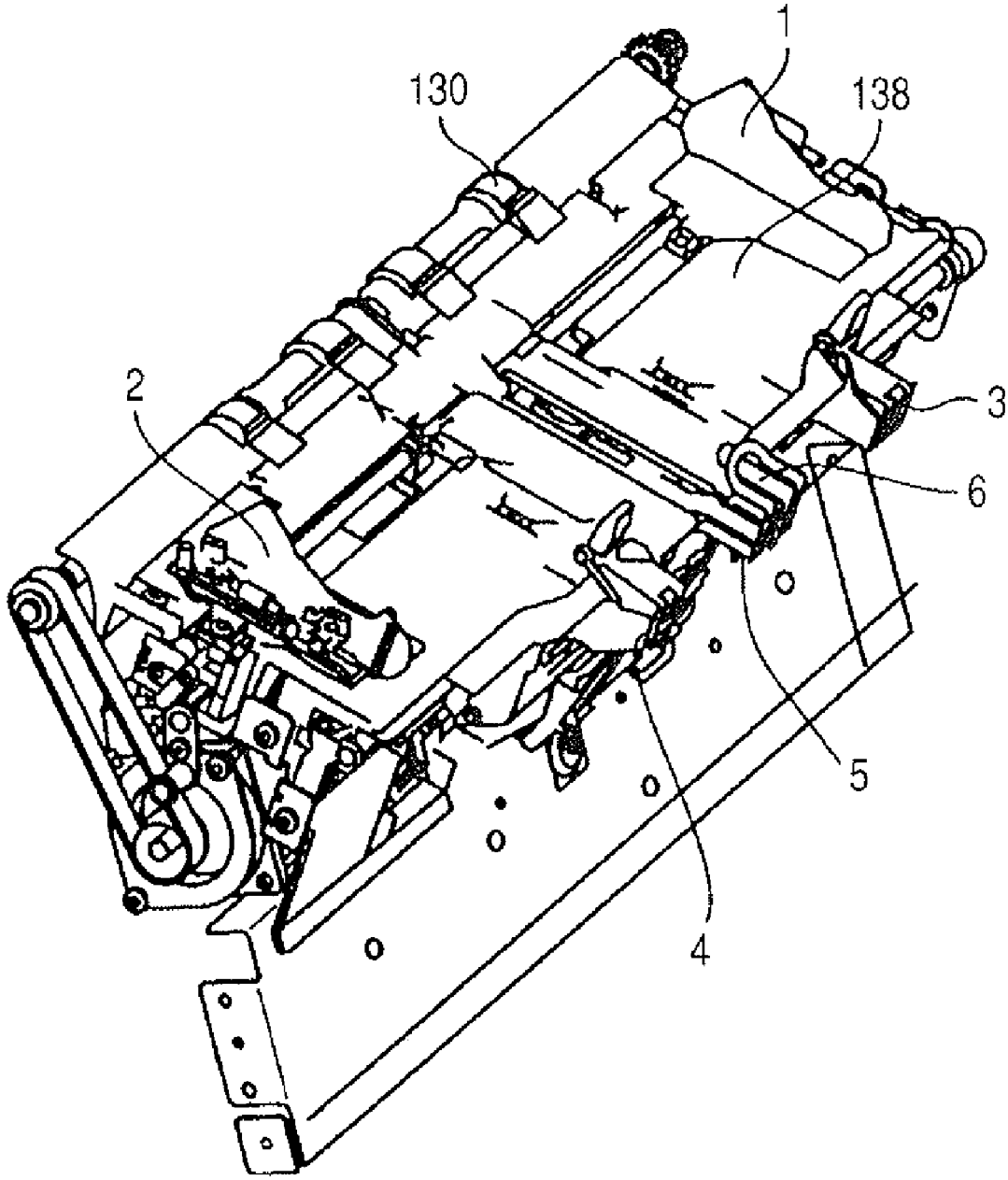
FIG. 3 is a rear perspective view of a process tray of the sheet processing apparatus.

After that, the sheets are delivered onto the process tray 138 by a lower discharge roller pair 128, and are then first subjected to alignment in the transport direction by return means, such as a paddle 131 and a knurled belt 129, and trailing end regulating members 3, 4, and 5 shown in FIG. 3, which are means for alignment in the transport direction.

Next, through alignment in the width direction by alignment members 1 and 2, a predetermined number of sheets are aligned on the process tray 138. These alignment devices are movable in the width direction, and are moved in the width direction by a drive source (not shown) to thereby effect alignment in the width direction on the sheets.

After that, one end binding or double binding is effected as needed by the stapler 132, which is the binding unit shown in FIG. 2. Then, the sheets are delivered onto the lower tray 137 by a sheet bundle discharge roller pair 130, which is a sheet discharge means, and a trailing end thrust member 6 described below, which is adapted to operate selectively. A peripheral surface of the sheet bundle discharge roller pair 130 (sheet transport rotary member) contacts with the sheets. The sheet bundle discharge roller pair 130 transport the sheets by rotating. The trailing end thrust member 6 transports the sheets by moving in the sheet transport direction while contacting the edge of the sheets.

Here, as shown in FIG. 2, in the sheet processing apparatus 100, the length of the process tray 138 (distance from the trailing end regulating members 3 through 5 to the sheet bundle discharge roller pair 130) is 180 mm or less. Thus, in particular, when the sheets are of a large size, such as A3 or LDR, the trailing ends of the sheets are stacked on the process tray 138. On the other hand, the leading ends of the sheets are aligned while placed on the stack tray 137 (or on already stacked sheets). This construction is effective in achieving space saving for the apparatus as a whole, and makes it possible to transport a sheet bundle of a half size, such as A4 or B5, by the sheet bundle discharge roller pair 130 alone.

Figure 4:
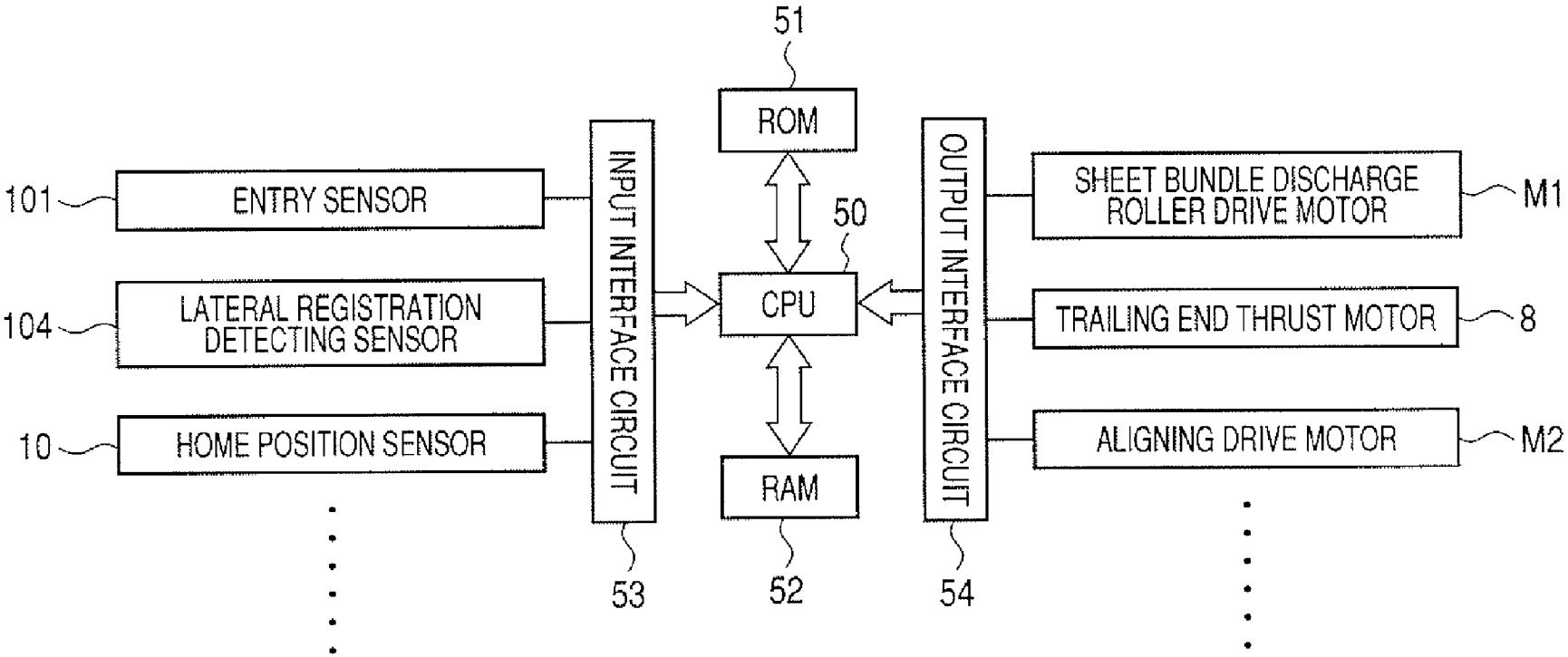
FIG. 4 is a control block diagram of the sheet processing apparatus.

FIG. 4 is a control block diagram of the sheet processing apparatus of this embodiment. In FIG. 4 numeral 50 indicates a CPU, numeral 51 indicates a ROM, and numeral 52 indicates a RAM. A puncher processing program, a stapling processing program, etc. are previously stored in the ROM 51. The CPU 50 executes each program, and performs input data processing while effecting data exchange as appropriate with the RAM 52, thereby preparing predetermined control signals.

Input to the CPU 50 through an input interface circuit 53 as input data are signals from the entry sensor 101, a home position sensor 10 for a trailing end thrust member described below, a lateral registration detecting sensor 104, etc.

Further, control signals from the CPU 50, which is a controller, are transmitted to a sheet bundle transport roller drive motor Ml and a drive motor 8 for driving the trailing end thrust member described below through an output interface circuit 54 and a motor driver (not shown). Further, control signals from the CPU 50 are also transmitted to an aligning drive motor M2 for driving the alignment members 1 and 2, etc., thereby controlling each motor as appropriate.

Here, in this embodiment, data communication is effected between the control device 950 provided on the apparatus main body 300 side and the CPU 50, whereby various items of information, such as the original size and the number of originals to be processed by an ADF, are taken in by the CPU 50.

Further, in this embodiment, information on the number of sheets (i.e., load of sheets) or on the coefficient of friction of the sheets and information on the number of positions where binding is to be effected on the sheets are input to the CPU 50 through the control device 950 by an operating portion 800 provided on the apparatus main body 300 side.

The CPU 50 selectively drives the trailing end thrust member described below based on the information from the operating portion 800, which serves as an information input means and a binding portion information input means. It is also possible for the control device 950 on the apparatus main body 300 side to serve as the CPU 50.

As is known in the art, to perform the staple process and the saddle stitch process, a fixed period of time is usually needed. This fixed period of time, which partially depends on the image forming speed on the apparatus main body 300 side, is generally longer than the ordinary sheet interval.

In view of this, to perform sheet processing without stopping the image forming operation on the apparatus main body 300 side, there is performed the so-called buffer processing described above. That is, under the condition, for example, that the preceding bundle is being processed on the process tray 138, buffering is performed in the buffering portion 999 by the first through third buffer roller pairs 115, 194, 112, respectively, and the buffer path 193, etc.

Next, such the sheet buffer processing will be described.

When the sheets of the first bundle have been all delivered onto the process tray 138 and aligned thereon, and while the aligned sheet bundle is being stapled by the stapler 132, the sheets constituting the next sheet bundle delivered from the image forming apparatus main body 300 are buffered in the buffer portion.

Figure 5A:
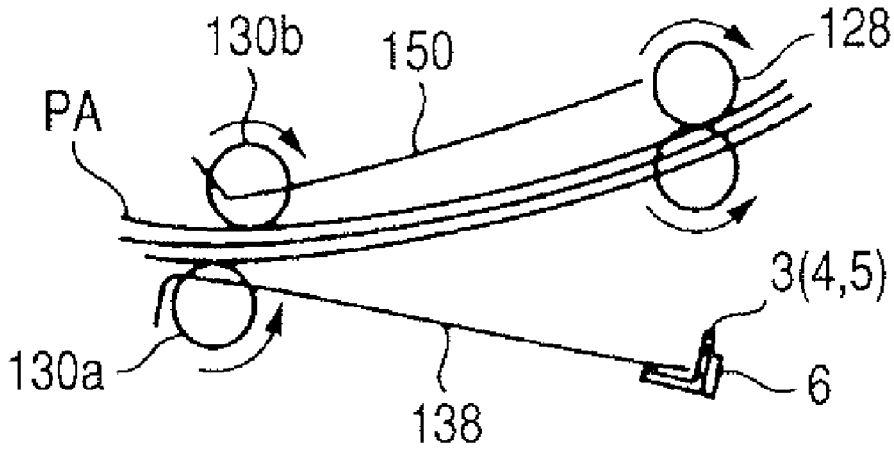
FIGS. 5A and 5B are diagrams illustrating operations of the sheet processing apparatus.
Figure 5B:
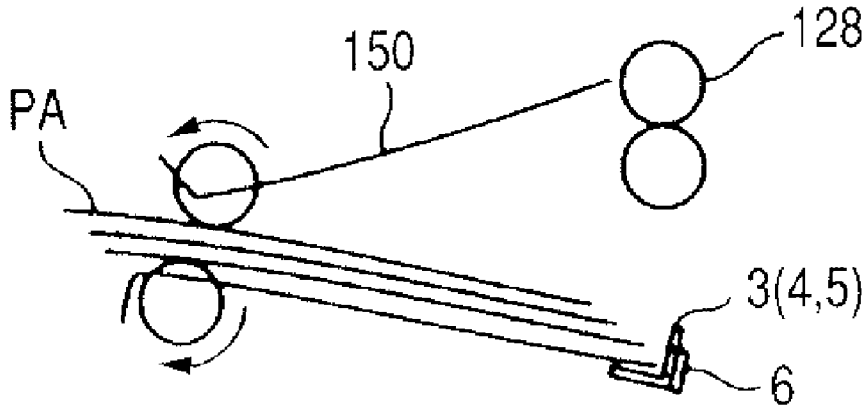

As shown in FIG. 5A, after the first sheet bundle is delivered onto the stack tray 137, the sheet bundle discharge roller pair 130 receive the second sheet bundle PA composed of three sheets superimposed one upon the other. After that, when the trailing end of the sheet bundle PA leaves the lower discharge roller pair 128, the sheet bundle discharge roller pair 130 is reversed, as shown in FIG. 5B, whereby the trailing end of the sheet bundle PA abuts the trailing end regulating members 3 through 5, and the trailing end of the sheet bundle PA is aligned.

Further, after trailing end alignment is thus performed on the sheet bundle PA, alignment is performed on a side end of the sheet bundle PA by the alignment members 1 and 2. The sheets from the fourth sheet P onward pass the same path as the first bundle, and are delivered onto the process tray. Then, a predetermined processing is performed. The bundles from the third bundle onward undergo the same operation as the second bundle, and a predetermined number of bundles are stacked on the stack tray 137 to thereby complete the processing.

In this embodiment, a sheet bundle which has been transported to and aligned on the process tray 138 by the buffer processing, etc. is subjected to staple processing before being delivered onto the stack tray 137, so there is provided the trailing end thrust member 6 shown in FIG. 3.

Here, the trailing end thrust member 6, which is a pressure member, moves while pressurizing the edge of the processed sheets on the process tray 138 to thereby transport the sheets in cooperation with the sheet bundle discharge roller pair 130; as shown in FIG. 3, it is arranged at the same position as the trailing end regulating member 5 at the center.

Further, as shown in FIGS. 5A and 5B, the trailing end thrust member 6 is provided at a position such that the distance between itself and the sheet bundle discharge roller pair 130 is within the length of the sheet in the sheet transport direction. With this arrangement, even when the trailing end thrust member 6 is not driven, it is possible to transport a sheet bundle by the sheet bundle discharge roller pair 130 alone. In this embodiment, the trailing end thrust member 6 is provided at a position retracted by a predetermined amount (i.e., 2 mm) from the trailing end regulating members 3 through 5 in the direction opposite to the sheet transport direction (i.e., sheet thrusting direction).

Figure 6:
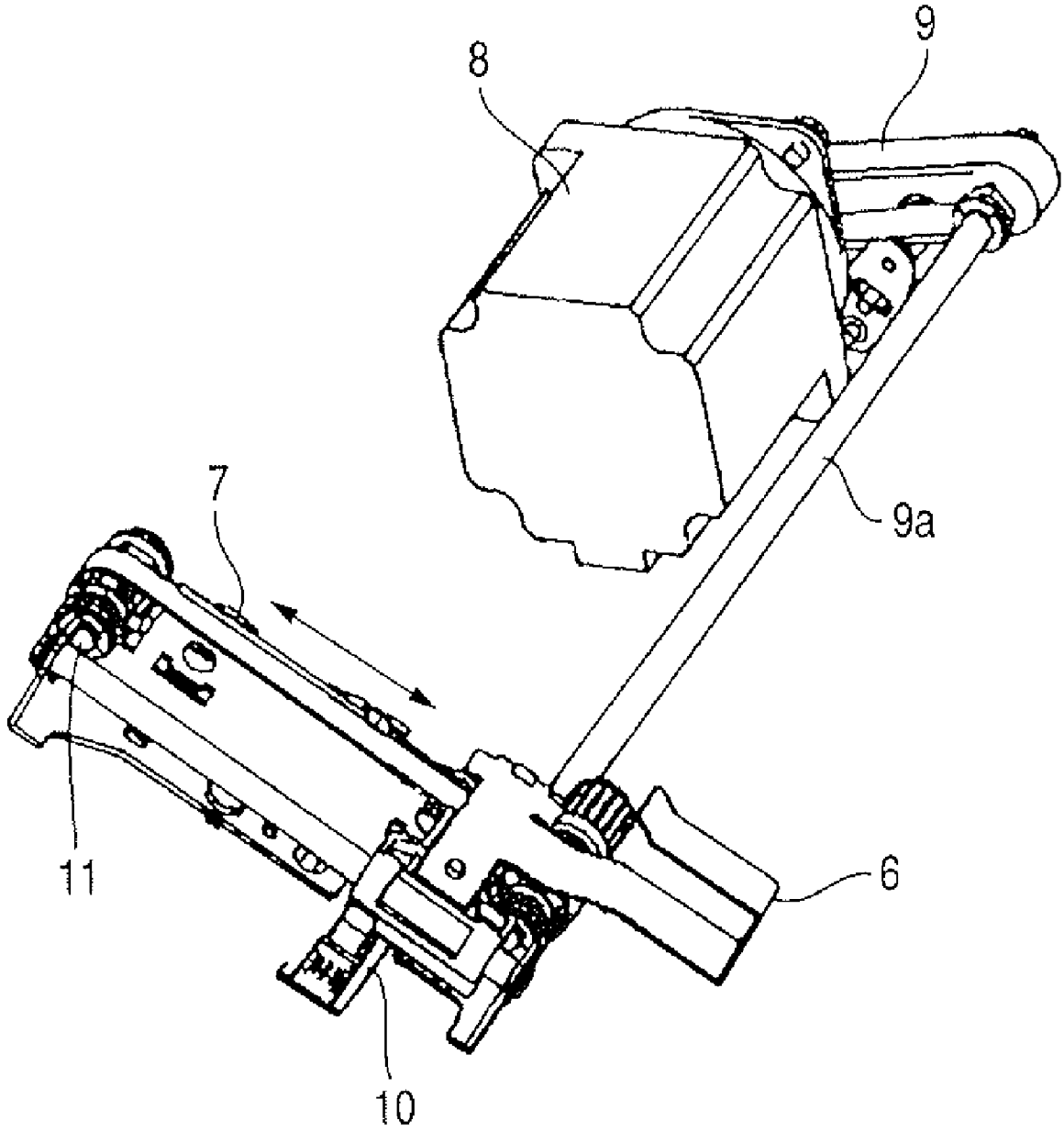
FIG. 6 is a perspective view illustrating a construction of a trailing end thrust member provided in the sheet processing apparatus.

As shown in FIG. 6, the trailing end thrust member 6 is fixed to a belt 7 run by the driving force of the trailing end thrust motor 8. The driving force of the trailing end thrust motor 8 is transmitted to the belt 7 through a drive belt 9 and a drive shaft 9*a* to cause the belt 7 to move in the directions of the arrows, whereby the trailing end thrust member 6 moves in the directions of the arrows.

In FIG. 6, numeral 10 indicates a home position sensor for detecting the home position of the trailing end thrust member 6; a signal from the home position sensor 10 is input to the CPU 50 as shown in FIG. 4 referred to above.

In this embodiment, the CPU 50 selectively drives the trailing end thrust member 6 according to the number of sheets of the sheet bundle (i.e., load of the sheet bundle), or a binding mode in which a binding portion is set.

Next, a drive control for the trailing end thrust member 6 will be described.

Figure 7:
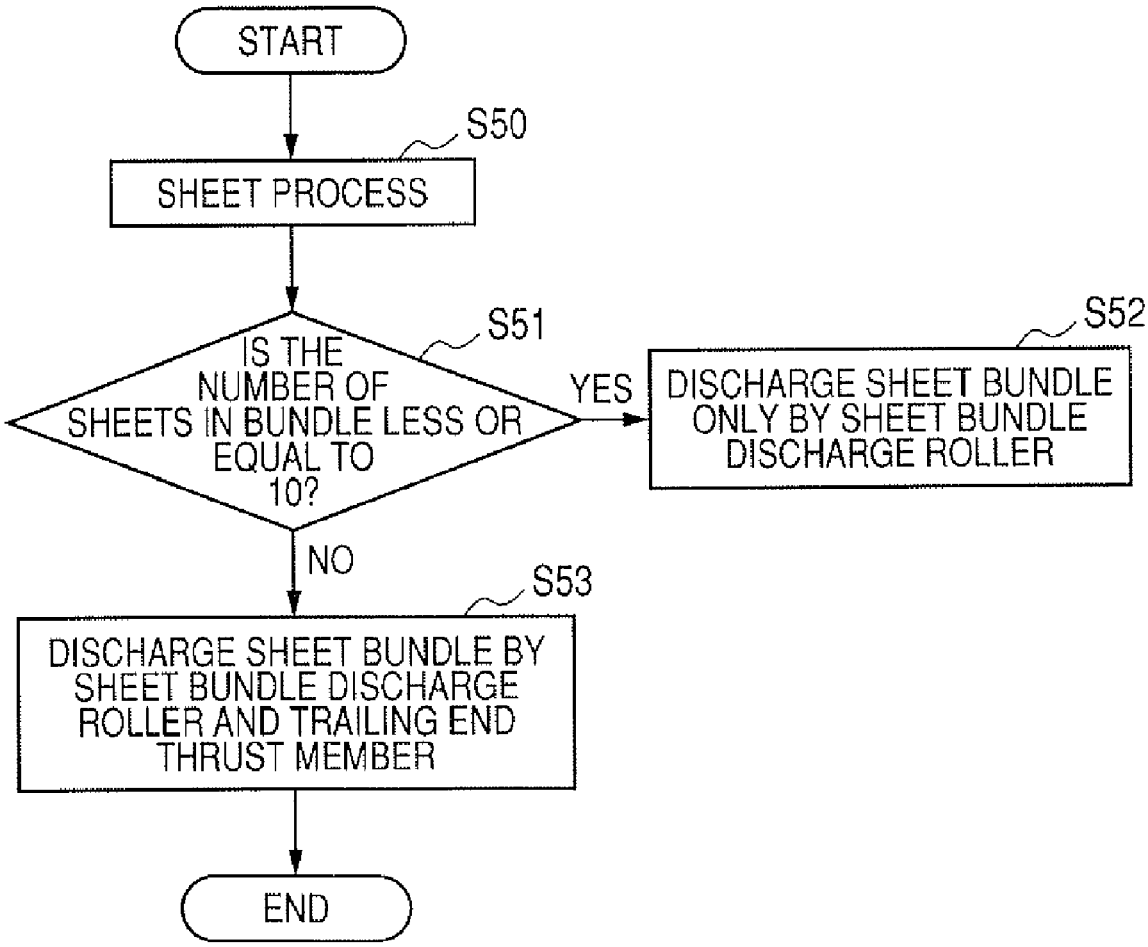
FIG. 7 is a flowchart showing a drive control for the trailing end thrust member.
Figure 8A:
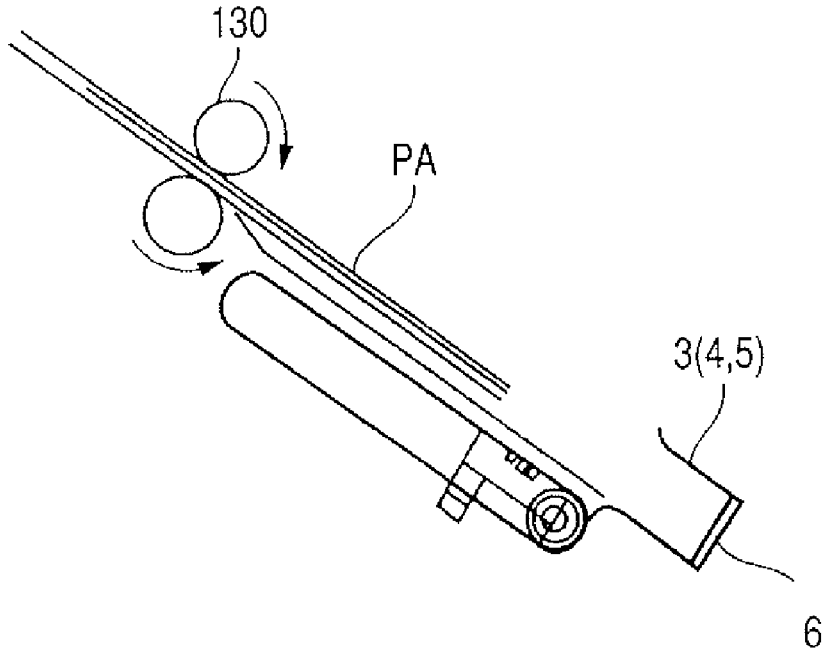
FIGS. 8A and 8B are diagrams illustrating operations of the trailing end thrust member.

For example, as shown in the flowchart of FIG. 7, the CPU 50 performs a processing, such as alignment or one-portion binding, on a sheet bundle transported to and aligned on the process tray 138 (S50). After that, based on the information from the operating portion 800, the CPU 50 makes a judgment as to whether the number of sheets of the sheet bundle processed is small, e.g., 10 or less, or not (S51). When the number of sheets of the sheet bundle processed is 10 or less (i.e., when the answer in S51 is YES), the discharge of the sheet bundle PA is possible with the sheet bundle discharge roller pair 130 alone, so the trailing end thrust member 6 is not driven, and the CPU 50 performs control such that the sheet bundle PA is transported by the sheet bundle discharge roller pair 130 alone as shown in FIG. 8A.

Figure 8B:
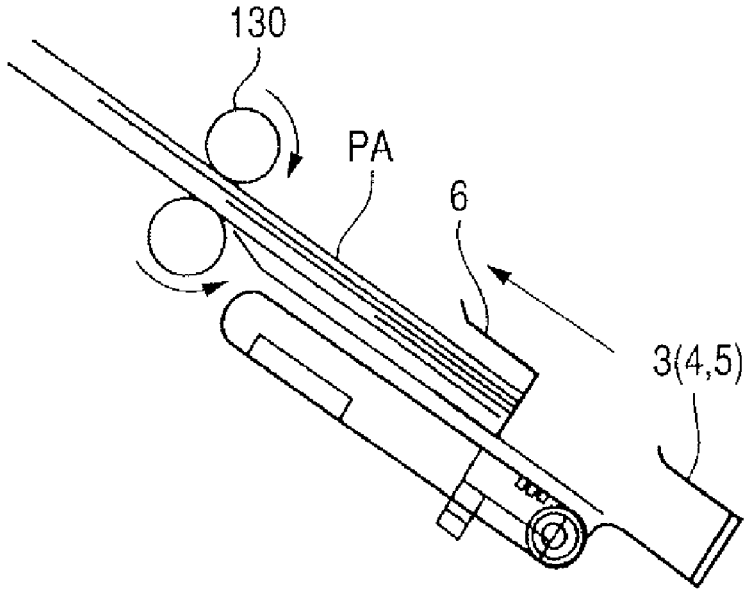

When it is determined by the CPU 50 that the number of sheet of the sheet bundle processed is not 10 or less (i.e., the answer in S51 is NO), the sheets Pc in the middle portion of the sheet bundle PA slip with the sheet bundle discharge roller pair 130 alone, and sheet bundle transport cannot be conducted properly. In view of this, as shown in FIG. 8B, the CPU 50 performs control such that the trailing end thrust member 6 is moved in synchronism with the sheet bundle discharge roller pair 130, transporting the sheet bundle PA together with the sheet bundle discharge roller pair 130. This makes it possible to perform sheet bundle transport properly.

That is, when the number of sheets of the sheet bundle processed is a predetermined number or less, the CPU 50 controls the trailing end thrust motor 8 so as not to operate the trailing end thrust member 6. When the number of sheets of the sheet bundle processed is larger than the predetermined number, the CPU 50 controls the trailing end thrust motor 8 so as to operate the trailing end thrust member 6.

In this way, the trailing end thrust member 6 is selectively driven based on the number of sheets of the sheet bundle, and the processed sheets are transported in cooperation with the sheet bundle discharge roller pair 130, whereby it is possible to achieve a reduction in power consumption, prevention of noise generation, an improvement in durability, and space saving. It is also possible to selectively drive the trailing end thrust member 6 according to the load of the sheet bundle, which differs depending on the sheet basic weight.

Further, even when color images have been transferred to the sheets of the sheet bundle, and the sheets exhibit a small coefficient of friction, sheet bundle transport is possible with the sheet bundle discharge roller pair 130 alone when, as in the double binding mode, the sheet bundle is bound by a plurality of binding means (i.e., stapling is effected at two portions).

Thus, when color images have been transferred to the sheets, and the sheets exhibit a small coefficient of friction, it is possible to adopt a construction in which the CPU 50 performs control so as not to operate the trailing end thrust member 6.

Further, when, as described below, the sheet bundle has one binding portion where binding is to be effected by the binding unit, the CPU 50 may perform control so as to operate the trailing end thrust member 6, and when there are two binding portions, the CPU 50 may perform control so as not to operate the trailing end thrust member 6.

Figure 9:
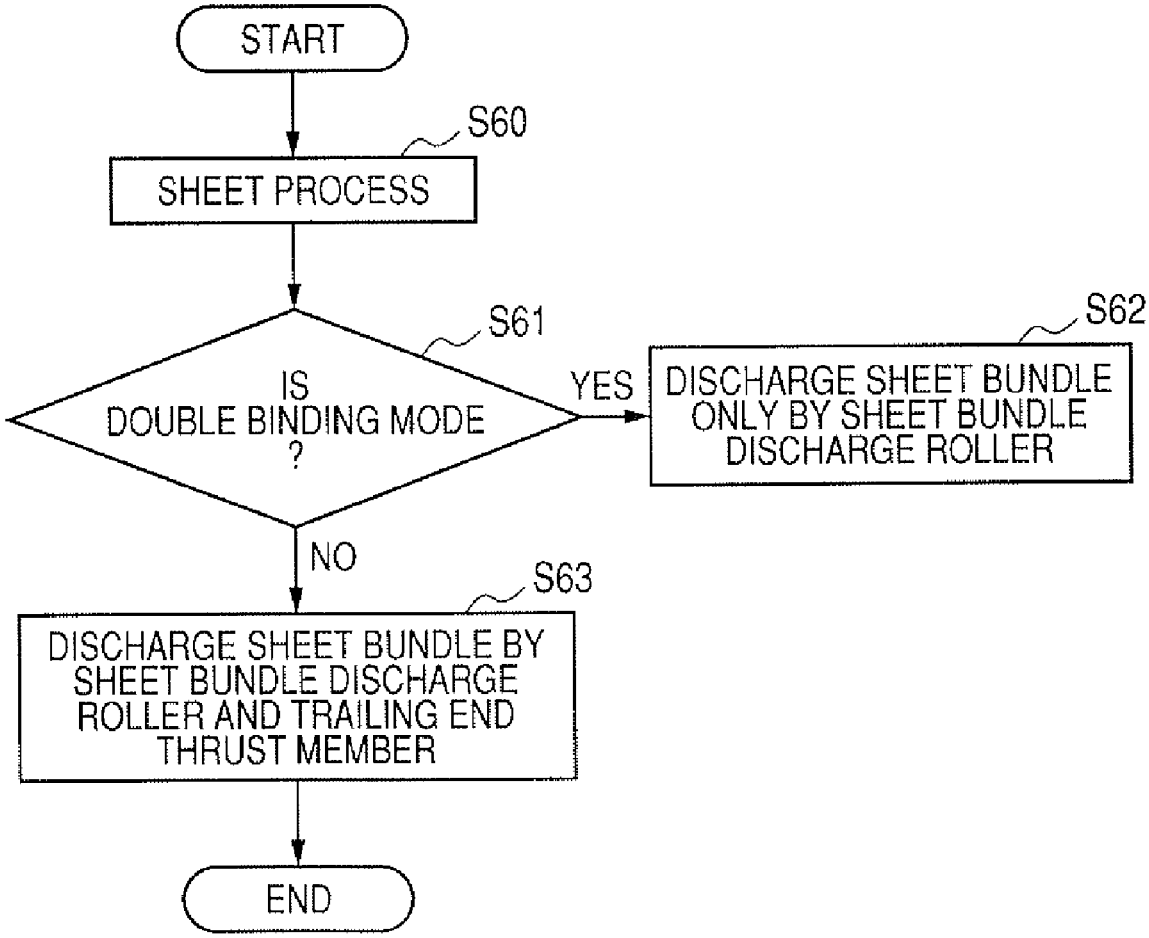
FIG. 9 is a flowchart showing another drive control for the trailing end thrust member.

In this case, as shown, for example, in the flowchart of FIG. 9, after a processing, such as binding, has been performed on the sheets transported to and aligned on the process tray 138 (S60), the CPU 50 makes a judgment as to whether the mode in which the sheet bundle has been processed is a double binding mode or not (S61). When it is determined by the CPU 50 that the mode in which the sheet bundle has been processed is the double binding mode (i.e., when the answer in S61 is YES), the CPU 50 performs control so as not to drive the trailing end thrust member 6 as shown in FIG. 8A and to transport the sheet bundle with the sheet bundle discharge roller pair 130 alone.

On the other hand, when it is determined by the CPU that the mode in which the sheet bundle has been processed is not the double binding mode (i.e., when the answer in S61 is NO), the CPU 50 performs control such that the trailing end thrust member 6 is moved in synchronism with the sheet bundle discharge roller pair 130 as shown in FIG. 8B, for transporting the sheet bundle PA together with the sheet bundle discharge roller pair 130. This makes it possible to perform sheet bundle transport properly. In this way, in the case of the double binding mode, solely the sheet bundle discharge roller pair 130 is driven, whereby it is possible to achieve a reduction in power consumption, prevention of noise generation, an improvement in durability, and space saving.

When the images formed on the sheets processed on the process tray 138 are neither color images nor solid images with a large amount of toner, the coefficient of friction of or between the sheets is relatively large. Also in this case, there is no need to operate the trailing end thrust member 6, and also in this case, the same effect can be achieved.

Figure 10:
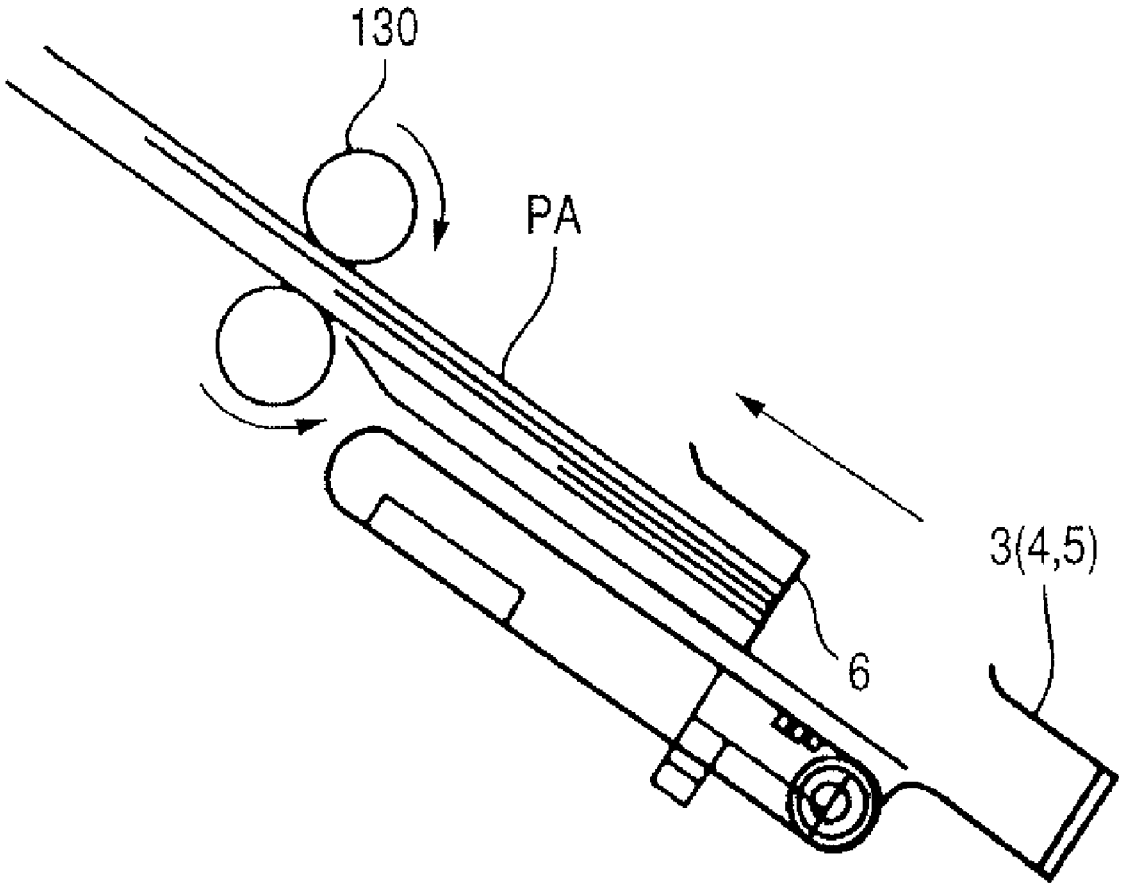
FIG. 10 is a diagram showing drive control elements of the trailing end thrust member.

Here, the basic formula of the condition allowing the above control is as follows:

$$\mu sP > Wps\alpha + G$$

where Wps is the weight of the sheet bundle; μs is the coefficient of friction between the sheets; P is the contact pressure of the sheet bundle discharge roller pair 130 shown in FIG. 10; α is the acceleration of the trailing end thrust member 6; and G is other resistance factor (gravitational force, guide resistance, etc.).

It is necessary to set the pressurizing force of the sheet bundle discharge roller pair 130 and the acceleration of the trailing end thrust member 6 such that the above relationship holds true, deciding between operation and non-operation of the trailing end thrust member 6.

In this embodiment, this can be achieved by setting the pressurizing force P to 10 to 15 N, the acceleration to 10 to 20 $m/s^2$ and the number of sheets in the bundle to approximately 120 at maximum. When the division of the number of sheets is effected using 10 sheets as a boundary, proper sheet bundle transport is possible.

In this way, the thrust member 6 is provided at a position where the distance between itself and the sheet bundle discharge roller pair 130 is within the sheet length in the sheet transport direction, and is driven selectively, whereby it is possible to achieve a reduction in power consumption, prevention of noise generation, an improvement in durability, an improvement in productivity, and space saving.

When transporting the processed sheets on the process tray 138 in cooperation with the sheet bundle discharge roller pair 130, the sheet bundle sags down if the sheet transport speed of the thrust member 6 is high, and the sheets in the middle portion slip when the sheet transport speed of the thrust member 6 is low, so it is impossible to transport the sheet bundle properly.

Thus, when driving the thrust member 6 selectively, it is necessary to control the speed (i.e., acceleration) of the sheet bundle discharge roller pair 130 and the thrust member 6.

Next, the second embodiment of the present invention, in which the speed (i.e., acceleration) of the sheet bundle discharge roller pair 130 and the thrust member 6 is controlled, will be described.

Figure 11A:
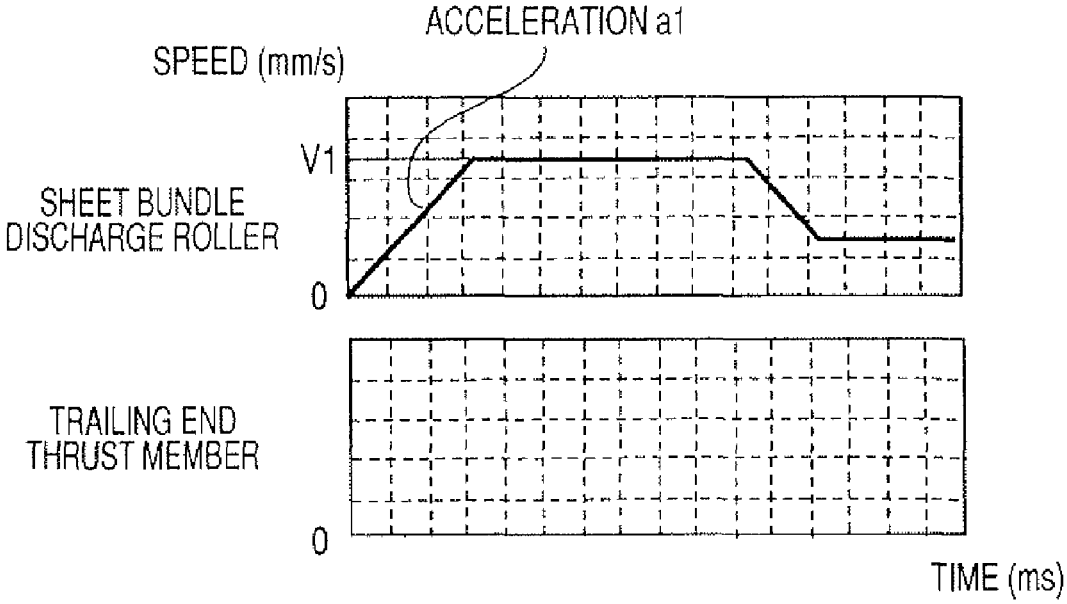
FIGS. 11A and 11B are diagrams illustrating speed controls for a sheet bundle transport roller and a trailing end thrust member provided in a sheet processing apparatus according to a second embodiment of the present invention.
Figure 11B:
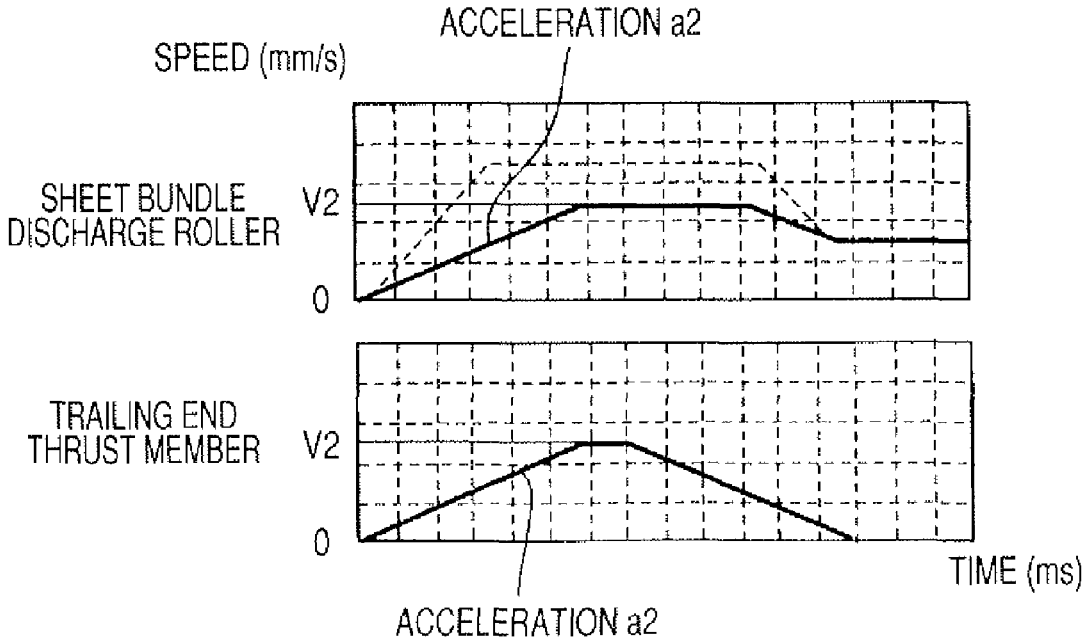
Figure 12:
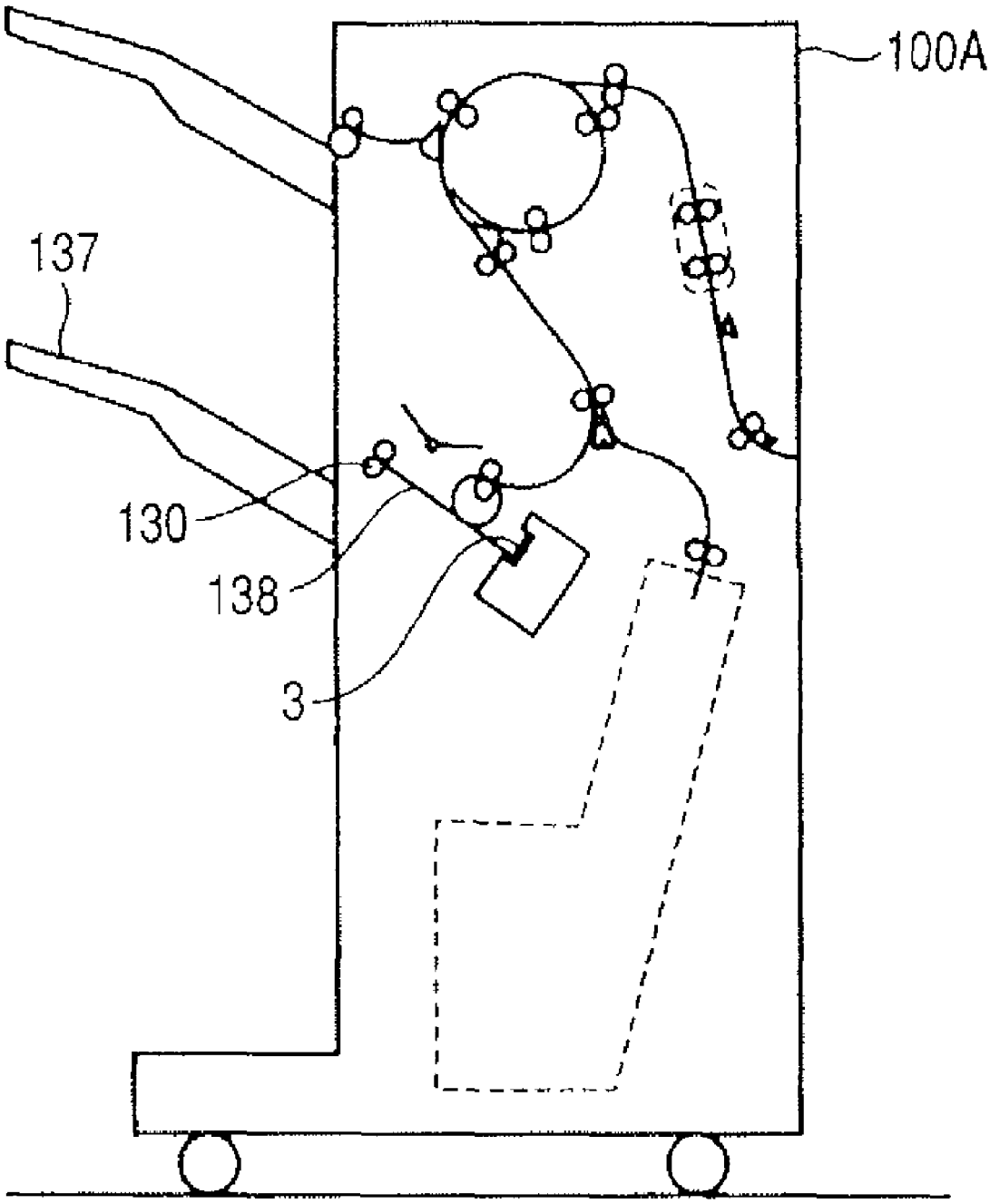
FIG. 12 is a diagram showing a construction of a conventional sheet processing apparatus.
Figure 13:
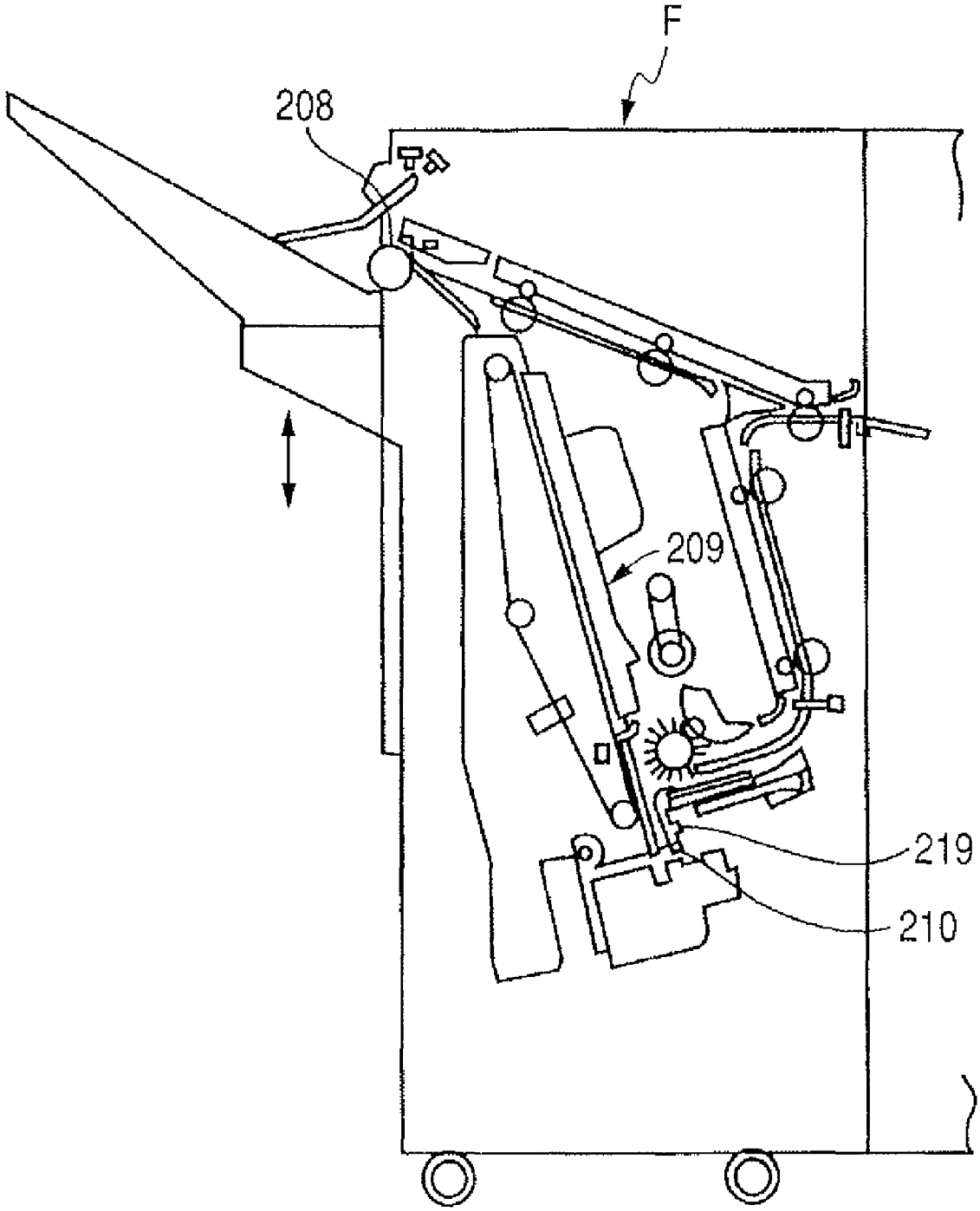
FIG. 13 is a diagram showing a construction of another conventional sheet processing apparatus.
Figure 14:
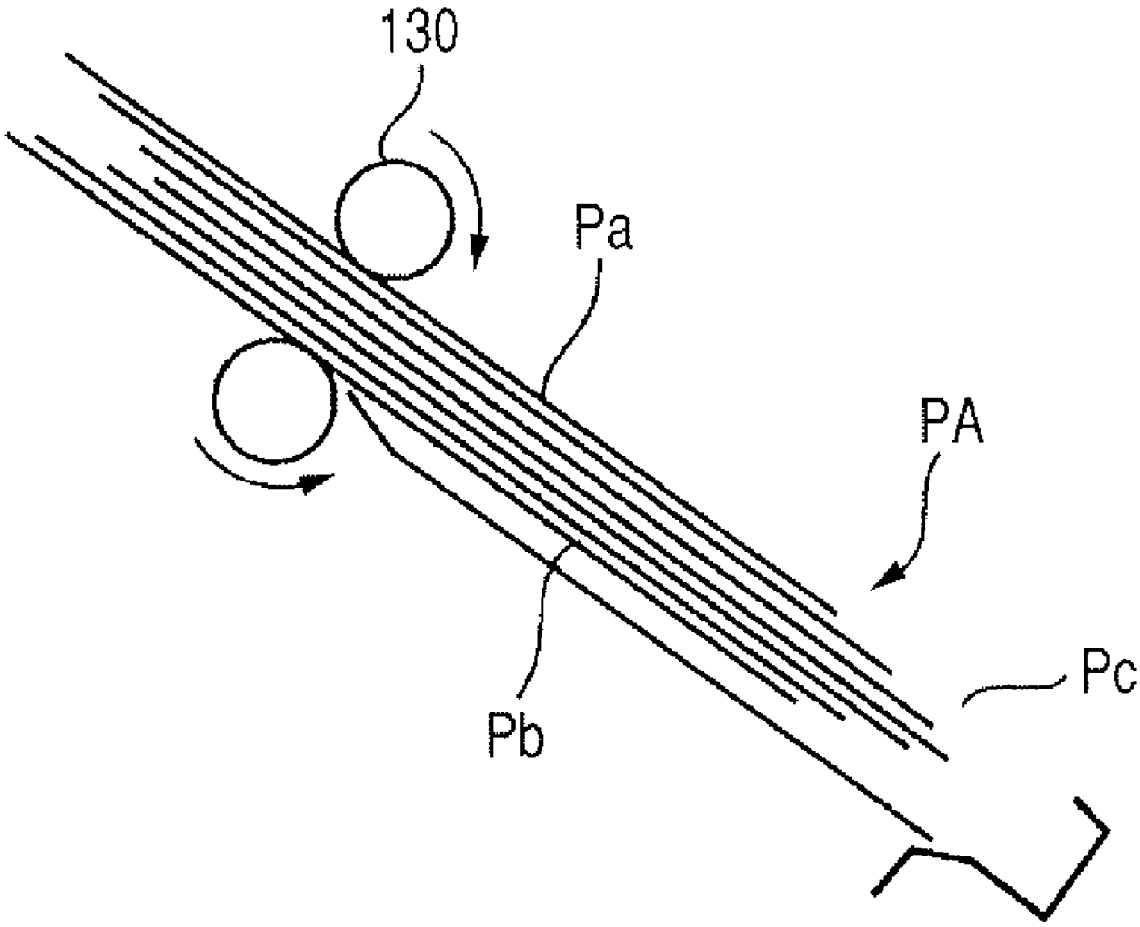
FIG. 14 is a diagram illustrating a problem with conventional sheet processing apparatuses.

FIG. 11A is a chart showing a speed control for the sheet bundle discharge roller pair 130 and the trailing end thrust member 6 when, for example, the number of sheets is small, and FIG. 11B is a chart showing a speed control for the sheet bundle discharge roller pair 130 and the trailing end thrust member 6 when the number of sheets is large. In each of FIGS. 11A and 11B, the horizontal axis indicates time, and the vertical axis indicates speed; the upper portion shows the operation of the sheet bundle discharge roller pair 130, and the lower portion shows the operation of the trailing end thrust member 6.

When the number of sheets is small, the trailing end thrust member 6 is not driven, so the CPU 50 performs control so as to drive solely the sheet bundle discharge roller pair 130 as shown in FIG. 11A. In this embodiment, the CPU 50, which functions as a speed control means, accelerates the sheet bundle discharge roller pair 130 at an acceleration al to thereby transport the sheets at a speed V1. After the sheet transport speed has attained V1, the sheets are transported at the speed V1.

When the number of sheets is large, the trailing end thrust member 6 is driven in synchronism with the sheet bundle discharge roller pair 130, and, as shown in FIG. 11B, is driven, like the sheet bundle discharge roller pair 130, at an acceleration a2, which is lower than that when the number of sheets is small, with the CPU 50 performing control to transport the sheets at a speed V2. When the sheet transport speed has attained V2, the CPU 50 performs control so as to transport the sheets at the speed V2. In this embodiment, proper sheet bundle transport is possible when a1=16 to 20 $m/s^2$ and a2=10 to 12 $m/s^2$ hold true; however, this should not be construed restrictively.

By thus driving the trailing end thrust member 6 and the sheet bundle discharge roller pair 130 at the same acceleration, it is possible to transport the trailing end thrust member 6 and the sheet bundle discharge roller pair 130 at the same transport speed, thereby making it possible to perform a proper sheet bundle transport.

Further, by setting the acceleration to a2, which is lower than the acceleration al when the number of sheets is small, it is possible to mitigate the shock when the trailing end thrust member 6 abuts the sheet bundle. By thus adopting a relatively low acceleration, the requisite time for sheet bundle discharge increases; however, in the case of a bundle with a large number of sheets, it is possible for the number of sheets wrapped by a buffer means for gaining bundle processing intervals to be large, thereby making it possible to adopt a low acceleration as in this embodiment. As a result, it is possible to achieve space saving without affecting the processing time.

In the embodiments described above, the CPU 50 provided in the sheet processing apparatus 100 also send signals to the aligning drive motor M2 for driving the alignment members 1 and 2, etc., thereby controlling each motor as appropriate. However, it is also possible to adopt a form in which the aligning drive motor M2 for driving the alignment members 1 and 2, etc. are controlled by a controller provided in the apparatus main body 300.

Further, while in the above-described examples the sheet bundle discharge roller pair 130 is used as the sheet transport device for transporting the sheets on the process tray 138, it is also possible to adopt a form in which a rotary belt is used as the sheet transport means.

As in this embodiment, by selectively driving a pressure means for transporting the processed sheets in cooperation with the sheet transport means, it is possible to achieve a reduction in power consumption, prevention of noise generation, an improvement in durability, an improvement in productivity, and space saving.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-264780, filed Sep. 13, 2006, which is hereby incorporated by reference herein in its entirety.

What is claimed is:

1. A sheet processing apparatus which processes sheets, comprising:

a sheet process tray on which sheets to be processed are stacked;

sheet transport portion which transports processed sheets in a sheet transport direction;

a pressing member which is provided upstream of the sheet transport portion with respect to the sheet transport direction and which moves in the sheet transport direction to press the processed sheets in the sheet transport direction; and a controller which controls operation of the sheet transport portion and the pressing member, wherein the controller selectively controls such that when the number of sheets in the processed sheets on the sheet process tray is less than a predetermined number, the pressing member is not operated, and that when the number of sheets in the processed sheets is larger than the predetermined number, the pressing member is operated.

2. A sheet processing apparatus according to claim 1, wherein the controller makes acceleration of a sheet transport speed of the sheet transport portion and the pressing member when transporting sheets in cooperation with each other lower than acceleration of a sheet transport speed of the sheet transport portion when transporting the sheets by the sheet transport portion alone.

3. An image forming apparatus, comprising;

an image forming portion which forms an image on a sheet;

an information input portion which inputs an information on number of sheets; and a sheet processing apparatus which processes the sheets on which images have been formed by the image forming portion, the sheet processing apparatus comprising:

a sheet process tray on which sheets to be processed are stacked;

a sheet transport portion which transports processed sheets in a sheet transport direction;

a pressing member which is provided upstream of the sheet transport portion with respect to the sheet transport direction and which moves in the sheet transport direction to press the processed sheets in the sheet transport direction; and a controller which controls operation of the sheet transport portion and the pressing member, wherein the controller controls the operation of the pressing member based on the information on number of sheets from the information input portion, and selectively controls such that when the number of sheets in the processed sheets on the sheet process tray is less than a predetermined number, the pressing member is not operated, and that when the number of sheets in the processed sheets is larger than the predetermined number, the pressing member is operated.

4. An image forming apparatus, comprising:

an image forming portion which forms an image on a sheet;

an information input portion which inputs an information on sheet load;

a sheet processing apparatus which processes the sheets on which images have been formed by the image forming portion; and a controller which operates the sheet processing apparatus, the sheet processing apparatus comprising:

a sheet process tray on which sheets to be processed are stacked;

a sheet transport portion which transports processed sheets in a sheet transport direction; and a pressing member which is provided upstream of the sheet transport portion with respect to the sheet transport direction and which moves in the sheet transport direction to press the processed sheets in the sheet transport direction, wherein the controller controls the operation of the pressing member based on the information on sheet load from the information input portion, and selectively controls such that when the sheet load of sheets in the processed sheets on the sheet process tray is less than a predetermined sheet load, the pressing member is not operated, and that when the sheet load of sheets in the processed sheets is larger than the predetermined sheet load, the pressing member is operated.

5. An image forming apparatus according to claim 4, wherein the information on sheet load is information on the number of sheets.

6. An image forming apparatus, comprising:

an image forming portion which forms an image on a sheet;

an information input portion which inputs an information on number of sheets;

a sheet processing apparatus which processes the sheets on which images have been formed by the image forming portion; and a controller which operates the sheet processing apparatus, the sheet processing apparatus comprising:

a sheet process tray on which sheets to be processed are stacked;

a sheet transport portion which transports processed sheets in a sheet transport direction; and a pressing member which is provided upstream of the sheet transport portion with respect to the sheet transport direction and which moves in the sheet transport direction to press the processed sheets in the sheet transport direction, wherein the controller controls the operation of the pressing member based on the information on number of sheets from the information input portion, and selectively controls such that when the number of sheets in the processed sheets on the sheet process tray is less than a predetermined number, the pressing member is not operated, and that when the number of sheets in the processed sheets is larger than the predetermined number, the pressing member is operated.

* * * * *